US006547465B1

(12) United States Patent
Rago et al.

(10) Patent No.: US 6,547,465 B1
(45) Date of Patent: Apr. 15, 2003

(54) PENCIL WITH EXPOSABLE ERASER

(75) Inventors: Paul Rago, Danville, CA (US); David Small, San Jose, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 0 days.

(21) Appl. No.: 10/054,316

(22) Filed: Jan. 22, 2002

(51) Int. Cl.[7] ..... B43K 19/02; B43K 15/00; B43K 29/00; B43K 29/02

(52) U.S. Cl. ..... 401/17; 15/428; 15/429; 15/430; 15/431; 401/19; 401/34; 401/52; 401/55; 401/65

(58) Field of Search ..... 15/428, 429, 430, 15/431, 433, 434; 401/17, 19, 29, 32, 34, 52, 55, 65

(56) References Cited

U.S. PATENT DOCUMENTS

| | | | | |
|---|---|---|---|---|
| 35,467 | A | | 6/1862 | Oliver |
| 213,884 | A | | 4/1879 | de Faber |
| 328,778 | A | | 10/1885 | Holton |
| 342,956 | A | | 6/1886 | Foster |
| 364,916 | A | | 6/1887 | Goldsmith |
| 447,873 | A | | 3/1891 | Hanimann |
| 501,893 | A | | 7/1893 | Marshall |
| 536,935 | A | | 4/1895 | McIntyre |
| 606,551 | A | | 6/1898 | Huffman |
| 699,743 | A | | 5/1902 | Brownell |
| 703,229 | A | | 6/1902 | Boman |
| 795,500 | A | | 7/1905 | Faber |
| 806,235 | A | | 12/1905 | Bowen |
| 809,056 | A | | 1/1906 | Hayes |
| 840,372 | A | | 1/1907 | Reckendorfer |
| 870,990 | A | | 11/1907 | Payson |
| 1,018,288 | A | | 2/1912 | Yelp |
| 1,063,443 | A | | 6/1913 | Hayes |
| 1,093,497 | A | | 4/1914 | Swindowsky |
| 1,097,238 | A | | 5/1914 | Krell |
| 1,104,514 | A | | 7/1914 | Kilstrom |
| 1,176,909 | A | | 3/1916 | Lane |
| 1,237,013 | A | | 8/1917 | Boos |
| 1,248,988 | A | | 12/1917 | Antler |
| 1,276,511 | A | * | 8/1918 | Faber ..... 15/430 |
| 1,291,671 | A | | 1/1919 | Roll |
| 1,296,011 | A | | 3/1919 | Roll |
| 1,352,677 | A | | 9/1920 | Moore |
| 1,372,354 | A | | 3/1921 | Keeran |
| 1,379,608 | A | | 5/1921 | Bailey |
| 1,411,117 | A | | 3/1922 | Mason, Jr. |
| 1,441,000 | A | | 1/1923 | Keeran |
| 1,461,437 | A | | 7/1923 | Billman |
| 1,473,090 | A | | 11/1923 | Ferry |
| 1,567,910 | A | | 12/1925 | Brynda et al. |
| 1,580,183 | A | | 4/1926 | Veilette |

(List continued on next page.)

OTHER PUBLICATIONS

*Office Depot 1999–2000* Catalogue, PP. 536–538.
*Boise Cascade Office Products 2001* Catalogue, pp. 752–753.

*Primary Examiner*—Gregory L. Huson
*Assistant Examiner*—Kathleen J. Prunner
(74) *Attorney, Agent, or Firm*—Blakely Sokoloff Taylor & Zafman

(57) ABSTRACT

A pencil has a fixed non-replaceable eraser and a moveable sleeve. The fixed non-replaceable eraser is elongated to provide a larger eraser to pencil ratio in order to have more erase cycles per write cycles. The moveable sleeve can be moved to selectively expose a portion of the eraser. A ferrule couples the pencil body and the eraser together and provides an outer surface to engage an inner surface of the moveable sleeve. In one embodiment, a threaded female slot in the outer surface of the ferrule engages a male threaded tab in the inner surface of the sleeve. In another embodiment, a plurality of concentric slots in the outer surface of the ferrule engage a tab in the inner surface of the sleeve.

43 Claims, 6 Drawing Sheets

U.S. PATENT DOCUMENTS

| | | | |
|---|---|---|---|
| 1,590,126 | A | 6/1926 | Sheley |
| 1,662,474 | A | 3/1928 | Randall |
| 1,671,393 | A | 5/1928 | Zantow |
| 1,679,382 | A | 8/1928 | Sjobring |
| 1,702,780 | A | 2/1929 | Ingersoll |
| 1,903,474 | A | 4/1933 | Reckford |
| 1,937,104 | A | 11/1933 | Thomsen |
| 2,069,462 | A | 2/1937 | Rouse |
| 2,099,613 | A | 11/1937 | Loewus |
| 2,132,643 | A | 10/1938 | Pestel |
| 2,144,014 | A | 1/1939 | Finck |
| 2,164,433 | A | 7/1939 | Smith |
| 2,173,361 | A | 9/1939 | Gorrell |
| 2,181,202 | A | 11/1939 | Prain |
| 2,198,335 | A | 4/1940 | Gaimari |
| 2,204,038 | A | 6/1940 | Findra |
| 2,259,133 | A | 10/1941 | Harper |
| 2,261,314 | A | 11/1941 | Vogel |
| D130,935 | S | 12/1941 | Winterscheidt |
| 2,286,878 | A | 6/1942 | Tefft et al. |
| 2,287,894 | A | 6/1942 | Lynn |
| 2,293,993 | A | 8/1942 | Lynn |
| 2,314,777 | A | 3/1943 | Farrington |
| 2,358,091 | A | 9/1944 | Lovejoy |
| 2,369,047 | A | 2/1945 | Hasselquist |
| RE22,717 | E | 2/1946 | Savoie |
| 2,408,398 | A | 10/1946 | Johnson |
| 2,417,925 | A | 3/1947 | Gerster-Seiler |
| 2,452,795 | A | 11/1948 | Savoie |
| 2,452,905 | A | 11/1948 | Collura |
| 2,493,665 | A | 1/1950 | Gagnon |
| 2,501,612 | A | 3/1950 | Nielsen |
| 2,525,229 | A | 10/1950 | Lynn |
| 2,532,037 | A | 11/1950 | Robbins |
| 2,535,823 | A | 12/1950 | Van Benschoten |
| 2,785,100 | A | 3/1957 | Yaw |
| 2,790,202 | A | 4/1957 | Lorenian |
| 2,812,744 | A | 11/1957 | Maternick |
| 2,815,002 | A | 12/1957 | Mayes |
| 2,988,784 | A | 6/1961 | Lorenian |
| 3,072,101 | A | 1/1963 | Kovacs |
| 3,093,112 | A | 6/1963 | Shurcliff |
| 3,099,251 | A | 7/1963 | Hertz |
| 3,124,106 | A | 3/1964 | Kosta |
| 3,203,401 | A | 8/1965 | Specht |
| 3,262,425 | A | 7/1966 | Waugh |
| 3,437,413 | A | 4/1969 | Parker |
| 3,551,064 | A | 12/1970 | Bartner |
| 3,704,071 | A | 11/1972 | Muller et al. |
| 3,738,951 | A | 6/1973 | Middlebrook |
| 3,756,727 | A | 9/1973 | Gallagher |
| 3,918,819 | A | 11/1975 | Liu |
| 3,993,408 | A | 11/1976 | Arons et al. |
| 4,063,828 | A | 12/1977 | Mukai et al. |
| 4,176,978 | A | 12/1979 | Ruzicka et al. |
| 4,219,282 | A | 8/1980 | Kuo |
| 4,352,580 | A | 10/1982 | Ando |
| 4,374,225 | A | 2/1983 | Kawakubo et al. |
| 4,796,328 | A | 1/1989 | Horie |
| 4,856,693 | A | 8/1989 | Kagayama et al. |
| 4,899,419 | A | 2/1990 | Saleen |
| 4,904,101 | A | 2/1990 | Petterson |
| 4,918,130 | A | 4/1990 | Kano et al. |
| 4,979,254 | A | 12/1990 | Naujock |
| 5,015,111 | A | 5/1991 | Petterson |
| 5,018,891 | A | 5/1991 | Kageyama et al. |
| 5,022,774 | A | 6/1991 | Kageyama et al. |
| 5,062,727 | A | 11/1991 | Kageyama et al. |
| 5,127,130 | A | 7/1992 | Copito |
| 5,207,522 | A | 5/1993 | Kageyama et al. |
| 5,244,297 | A | 9/1993 | Bachelet et al. |
| 5,306,085 | A | 4/1994 | Kobayashi |
| 5,356,232 | A | 10/1994 | Skinner |
| 5,526,548 | A | 6/1996 | Ostrowski |
| 5,577,850 | A | 11/1996 | Mishima |
| 5,598,604 | A | 2/1997 | Ho |
| 5,709,491 | A | 1/1998 | Yeh |
| 5,774,931 | A | 7/1998 | Coinon et al. |
| 5,988,913 | A | 11/1999 | Kageyama et al. |
| 6,290,413 | B1 | 9/2001 | Wang |

* cited by examiner

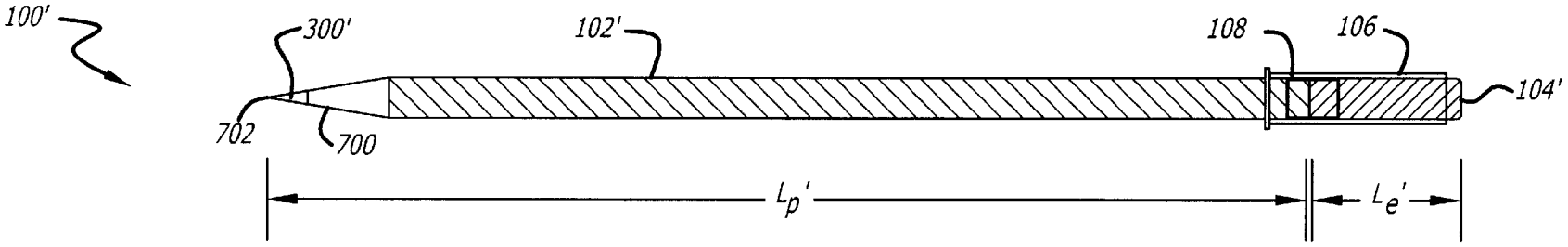
FIG. 7
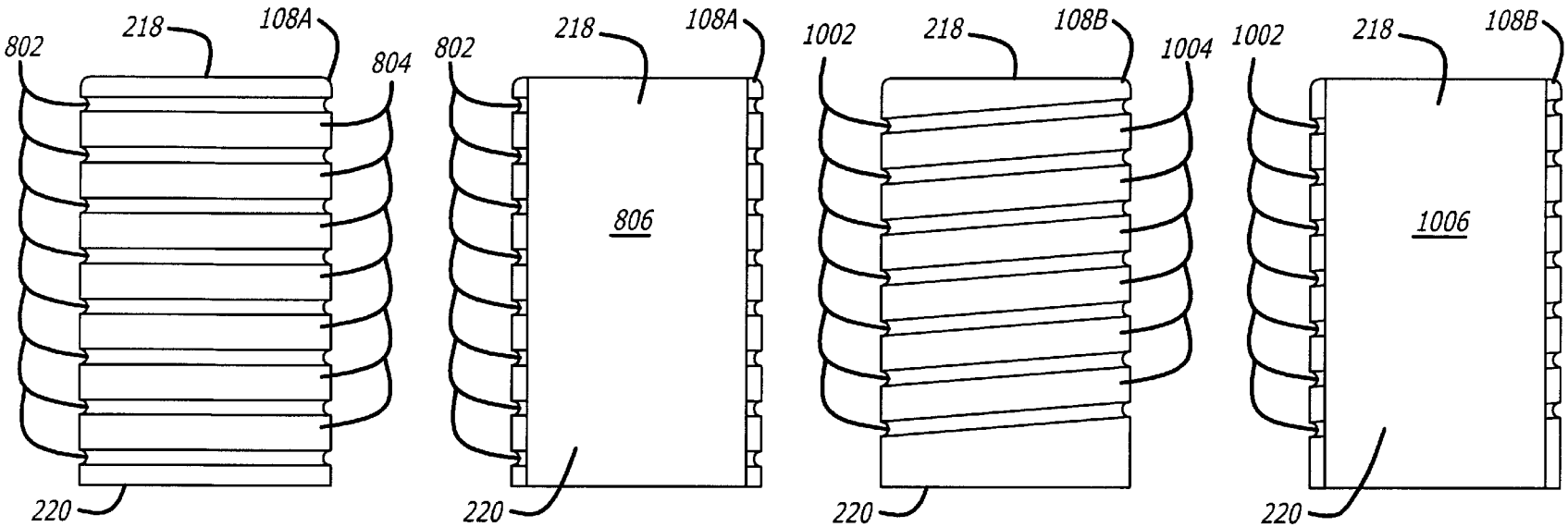
FIG.8A
FIG. 8B
FIG. 10A
FIG. 10B

PENCIL WITH EXPOSABLE ERASER

FIELD OF THE INVENTION

The invention relates generally to the field of writing instruments. Particularly, the invention relates to pencils with erasers.

BACKGROUND OF THE INVENTION

Graphite or lead pencils are well known and are often used for drawing and writing. Lead pencils may have a graphite center for drawing in gray or black on a paper or page. Lead pencils may have a colored center for drawing in colors, such as red green or blue, on a paper or page.

At a sharp end of lead pencils there is a tip or point of the graphite or colored center extending from a conical portion of the body which surrounds the graphite or colored lead center. When the tip or point breaks or wears out, a user need only sharpen the lead pencil to remove additional body material surrounding the graphite or colored center in order that a new tip or point of graphite or color appear for writing or drawing. As the tip or point of graphite or color is dragged across an object such as paper, graphite or color can be left behind on the object to leave a mark. In some cases, particularly when drawing, it is desirable to remove the graphite or color and the marks using an eraser.

For convenience, some lead pencils include an inexpensive rubber eraser affixed to a butt end of the pencil, opposite the sharp end having the tip or point. A user need only rub the rubber eraser over a mark on the object and the graphite or color of the mark may be removed. As the eraser is rubbed over surfaces of objects, some rubber is worn off reducing its length and the usable amount of the eraser.

In many instances, the rubber eraser on the end of the pencil is used often to erase. Typically, the rubber eraser that is fixed to the end of the pencil is relatively short in comparison to the length of the available lead pencil. Thus, the eraser can quickly be worn out to little usable length. In this case, a user is often left with a long pencil with no usable eraser affixed to the end. In another case, the eraser affixed to the end of the pencil is often abused by a user by biting or chewing it to a minimal length so that its unusable.

With no usable eraser affixed to the end, a user may choose to avoid using the pencil. Older pencils without usable erasers seem to stockpile around desks, may be hidden in drawers, or are thrown out. New pencils with new erasers are often purchased only to obtain pencils with usable erasers, even though older pencils with no usable eraser have a substantial amount of lead pencil remaining which can be used to draw and write.

BRIEF DESCRIPTION OF THE DRAWINGS

The features of the invention will become apparent from the following detailed description of the invention in which:

FIG. 7 is assembled top view of an embodiment of the invention which has wear over that shown in FIG. 1.

FIGS. 8A–8B are magnified views of an embodiment of the ferrule or eraser holder.

FIGS. 10A–10B are magnified views of another embodiment of the ferrule or eraser holder.

Like reference numbers and designations in the drawings indicate like elements providing similar functionality.

DETAILED DESCRIPTION OF THE INVENTION

In the following detailed description of the invention, numerous specific details are set forth in order to provide a thorough understanding of the invention. However, it will be obvious to one skilled in the art that the invention may be practiced without these specific details. In other instances well known methods, procedures, components, and circuits have not been described in detail so as not to unnecessarily obscure aspects of the invention.

The invention includes a substantially longer eraser coupled to the end of a pencil and an eraser sleeve. The eraser sleeve is selectively movable so that a proper amount of eraser is exposed to provide good eraser operation. The elongated eraser is relatively flexible over its length. The eraser sleeve provides structural support to the elongated eraser to provide proper eraser operation. In one embodiment, the eraser sleeve slides from stop point to stop point to expose an erasing portion of the eraser. In another embodiment, the eraser sleeve can be rotated to expose a continuously variable amount of eraser. The eraser sleeve can also completely cover the elongated eraser so that it is protected from damage. The eraser sleeve can include advertising, marks, or ornamental characters on an outside surface of may have an external shape of an object or character.

Figure 1:
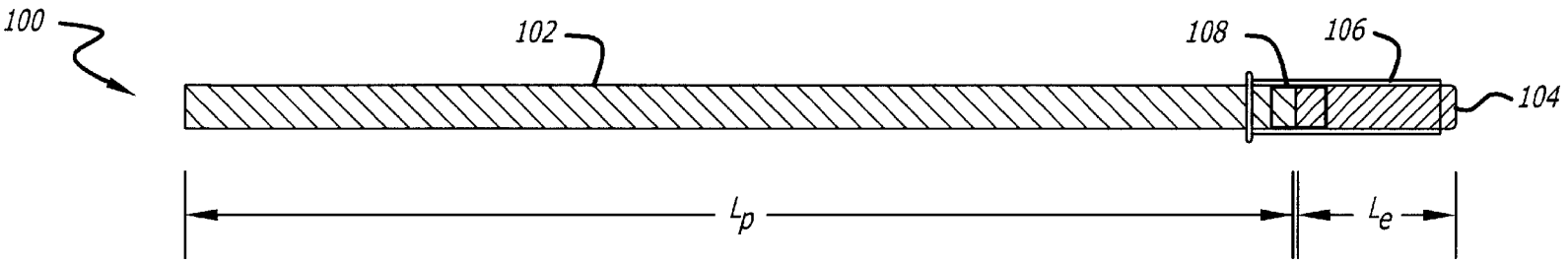
FIG. 1 is an assembled top view of an embodiment of the invention.

Referring now to FIG. 1, a writing instrument or pencil 100 is illustrated. The pencil 100 includes a shank or lead pencil body 102, and an elongated eraser 104, an eraser sleeve 106, and a ferrule 108. The ferrule may also be referred to as a tube, a bushing, or an eraser holder. The lead pencil body 102 has an initial length $L_p$. The elongated eraser 104 has an initial length $L_e$. The ratio of the length of the eraser $L_e$ to the length of the lead pencil $L_p$ provide by the invention is greater than a typical pencil with an eraser. With the elongated eraser 104, the wear and use of the eraser more closely matches the sharpening and use of the lead in the lead pencil body 102. In one embodiment, the total length of the eraser 104 is one inch and the length of the lead pencil body 102 is approximately six and one-half inches. In this case, approximately three-fourths of an inch of the eraser 104 and six and one-fourth inches of the lead pencil body extends out beyond the ferrule 108. These dimensions of the invention provide an 8.33:1 ratio of lead to eraser. In other embodiments the ratio may be even less. In a typical number two pencil, less than one-fourth of an inch of an eraser and six and three-fourths inches of a lead pencil body may extend out beyond a ferrule. The typical number two pencil has a 27:1 ratio of lead to eraser. In this embodiment of the invention, three times as much eraser is provided for a reduction of about one-half inch in the lead pencil body. In other embodiments, the elongate eraser 104 has a greater length and the lead pencil body 102 may have a shorter length to maintain a standard size overall length in the writing instrument or pencil 100.

The elements and formation of the lead pencil body 102 are well known. The elongated eraser 104 is a fixed or non-replaceable eraser. The elongated eraser 104 may be formed of rubber, gum, vinyl, silicon, or other known type of eraser material. One end of the elongated eraser 104 is coupled to one end of the ferrule 108. One end of the lead pencil body 102 is coupled to an opposite end of the ferrule 108.

The eraser sleeve 106 is moveable to expose portions of the eraser 104 for erasing. In one embodiment, the eraser sleeve 106 can be moved to extend out to its maximum extent so that it can protect the entire elongated eraser 104. In another embodiment, the eraser sleeve 106 extends out to its maximum extent to protect just a portion of the elongated eraser 104. In one embodiment, the eraser sleeve 106 is slideable. In another embodiment, the eraser sleeve 106 is screwable. In order to selectively expose portions of the elongated eraser 104, an inside surface of the eraser sleeve 106 engages an outer surface of the ferrule 108. All or part of the elongated eraser 104 may be exposed and covered by the eraser sleeve 106. Note that the elongated eraser 104 is fixed and does not move with respect to the pencil 100. That is, the eraser 104 does not extend out or dispense from the lead pencil body 102. Nor does the eraser 104 retract into the lead pencil body 102.

Figure 2:
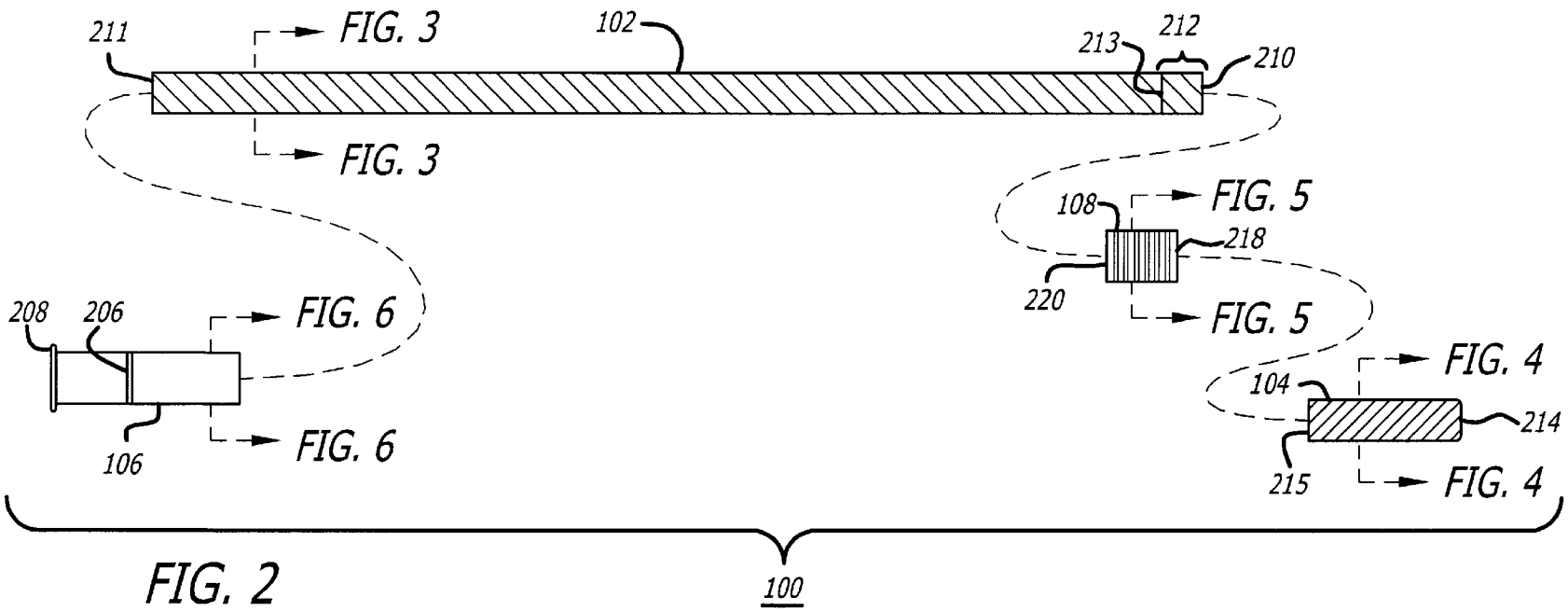
FIG. 2 is an exploded view of the elements of FIG. 1.

Referring now to FIG. 2, an exploded view of the writing instrument or pencil 100 is illustrated. The eraser sleeve 106 has a hollow cylindrical shape like a tube. The eraser sleeve is dimensioned to slide over the lead pencil body 102 and the elongated eraser 104 and to engage the ferrule 108. The eraser sleeve 106 includes a tab or thread 206 on an inner surface to engage the ferrule 108 and selectively expose the eraser 104. The eraser sleeve 106 may further include a flange or lip 208 to but up against an edge of the ferrule 108 to deter further movement in one direction. Exemplary cross sections of the eraser sleeve 106 are illustrated in FIGS. 6A–6D.

In FIG. 2, the lead pencil body 102 includes a butt end 210 and a writing or sharpenable end 211. The butt end 210 of the lead pencil body is coupled into an end of the ferrule 108. In one embodiment, the pencil body 102 includes a terminal portion 212 and an annular shoulder 213. The terminal portion 212 may have a different dimension and cross-section than that of the rest of the lead pencil body 102. The terminal portion 212 may be specifically dimensioned or have a specific cross-section to couple into a pencil socket 220 of the ferrule 108 up to the annular shoulder 213. Alternatively, the lead pencil body 102 may be specifically dimensioned to couple into the pencil socket 220 of the ferrule 108. Exemplary cross sections of the lead pencil body 102 are illustrated in FIGS. 3A–3D.

In FIG. 2, the elongated eraser 104 includes a butt end 215 and an eraseable end 214. The butt end 215 of the elongated eraser 104 is coupled into an end of the ferrule 108. The elongated eraser 104 may be specifically dimensioned to fit into an eraser socket of the ferrule 108. Within the ferrule 108, the butt end 215 of the elongated eraser 104 may butt up against the butt end 210 of the lead pencil body 102. Exemplary cross sections of the elongated eraser 104 are illustrated in FIGS. 4A–4D.

The ferrule 108 is hollow and cylindrically shaped in one embodiment. The ferrule 108 acts like a bushing to join together the lead pencil body 102 and the eraser 104. The ferrule 108 includes an eraser socket 218 at one end and a pencil socket 220 at an opposite end. The eraser socket 218 is an opening at the end of the ferrule 108 which is dimensioned to receive the cross sectional dimension of the elongated eraser 104. The butt end 215 of the elongated eraser 104 is inserted into the eraser socket 218 of the ferrule 108. The pencil socket 220 is an opening at the end of the ferrule 108 which is dimensioned to receive the cross sectional dimension of the lead pencil body 102. The butt end 210 of the lead pencil body 102 is inserted into pencil socket 220 of the ferrule 108. In one embodiment, the terminal portion 212 of the pencil body 102 is inserted into the pencil socket 220 up to the annular shoulder 213. The ferrule 108 may be fastened to the eraser 104 and the lead pencil body 102 in a number of ways.

In one embodiment, the ferrule 108 may crimp or clamp onto the lead pencil body 102 and the eraser 104 near their respective butt ends 210 and 215. Dimples may be pressed into the ferrule 108 to poke into the lead pencil body 102 and the elongated eraser 104. In another embodiment, the ferrule 108 may including fastening tabs which poke or dig into the lead pencil body 102 and/or the eraser 104. In yet another embodiment, stakes or studs may be forced through the ferrule 108 and into the lead pencil body 102 and/or the eraser 104. In another embodiment, a glue or cement is used in conjunction with the ferrule 108 to couple together the eraser 104 and pencil body 102. In any case, the eraser 104 and the lead pencil body 102 are permanently fixed, coupled, or joined together. In other words, the eraser 104 is not refillable or replaceable. The eraser 104 does not move with respect to the lead pencil body 102. Other known ferrule embodiments and known coupling methods may be used to couple the eraser 104 and the lead pencil body 102 together.

The ferrule 108 and the eraser sleeve 106 are formed of solid materials. Either one or both may be formed of plastic, metal or other solid material. In a preferred embodiment, the ferrule 108 is metal and the eraser sleeve 106 is plastic.

The writing instrument or pencil 100 is assembled by inserting an end of the lead pencil body 102 into an opening in the ferrule 108. An end of the elongated eraser 104 is inserted into an opposite end of the ferrule 108. Around the ends of the ferrule 108, the ferrule 108 is crimped, clamped or somehow staked into the sides of the elongated eraser 104 and lead pencil body 102 near their respective butt ends. The eraser sleeve 106 is then slid over the sharpening end of the lead pencil body 102 up to the ferrule 108. Then, the tab or thread in the inner surface of the eraser sleeve 106 is engaged with the slot or thread in the outer surface of the ferrule 108.

Referring now to FIGS. 3A–3D, exemplary cross sections of the lead pencil body 102 are illustrated. The lead pencil body 102 is coaxial with a writing core, lead core or lead center; a barrel, sheath or casing around the lead center; and an outer skin or coating around the casing. In an alternate embodiment, the lead pencil body may include other intermediate layers of materials to provide additional protection to the lead center and avoid breakage of the lead pencil body. The lead pencil body 102 is generally cylindrically shaped. The lead center, casing, and coating are generally cylindrically shaped along the length of the lead pencil body 102 when the pencil is unsharpened. When sharpened, the coaxial layers are removed to expose the lead center.

The lead pencil body 102 provides no mechanical means for extending the lead center out from the casing. The lead pencil body 102 is non-mechanical and requires sharpening in order to peel the outer skin and the casing away from the lead center so that the writing tip or point of the lead center is exposed. In other words, the lead center, casing, and outer skin are coupled together so that the lead center is in a fixed position.

Figures 3A, 3B, 3C, 3D:
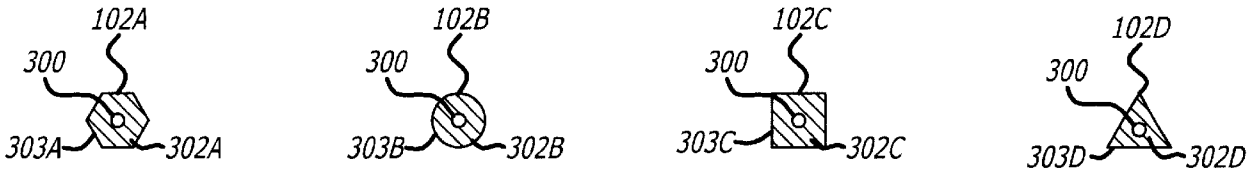
FIGS. 3A–3D are exemplary cross sectional views of a lead pencil body.

In FIG. 3A, the lead pencil body 102A has a hexagonally shaped cross section to form a hexagonal cylinder or prism. The lead pencil body 102A includes the writing core, lead core or lead center 300; the barrel, sheath or casing 302A; and the outer skin or coating 303A. In FIG. 3B, the lead pencil body 102B has a circular shaped cross section to form a circular cylinder. The lead pencil body 102B includes the lead center 300, the casing 302B, and the outer skin 303B. In FIG. 3C, the lead pencil body 102C has a rectangular or square shaped cross section to form a square cylinder or rectangular cylinder. The lead pencil body 102C includes the lead center 300, the casing 302C, and the outer skin 303C. In FIG. 3D, the lead pencil body 102D has a triangular shaped cross section to form a triangular cylinder. The lead pencil body 102D includes the lead center 300, the casing 302D, and the outer skin 303D.

In any case, the lead center may also be referred to as a writing core, a lead core, or a fixed lead center. The casing may also be referred to as a barrel or a sheath. The coating may also be referred to as an outer skin.

The lead center 300 may be formed of a graphite composite, a wax, or other known marking medium to form black or color eraseable marks. In one embodiment, graphite is mixed with clay in various amounts to vary the hardness of the lead center 300. The casings 302A–302D may be formed of wood parts such as cedar, plastic, a composite material, or other known materials. The outer skin 303A–303D may be a lacquer or other protective coating painted and or printed onto the casing 302A–302D. The outer skin 303A–303D of the lead pencil body 102 may include advertising, a trademark, or other letters, designs, or characters, printed, painted, stamped, or integrated into the outer skin.

Figures 4A, 4B, 4C, 4D:
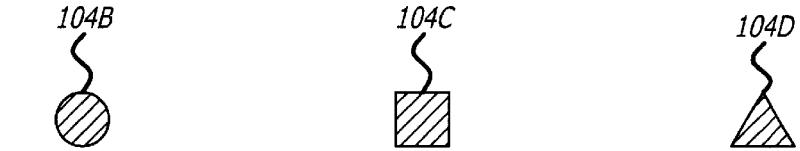
FIGS. 4A–4D are exemplary cross sectional views of an elongated eraser.

Referring now to FIGS. 4A–4D, exemplary cross section shapes of the elongated eraser 104 are illustrated. In FIG. 4A, the elongated eraser 104A is a hexagonal cylinder having a hexagonal cross-section. In FIG. 4B, the elongated eraser 104B is a circular cylinder having a circular cross-section. In FIG. 4C, the elongated eraser 104C is a square cylinder having a square or rectangular cross-section. In FIG. 4D, the elongated eraser 104D is a triangular shaped cylinder having a triangular cross-section. The diameter of the elongated eraser 104 may be similar to the diameter of the lead pencil body 102 to use a uniformly sized ferrule 108. The cross-sectional shape of the elongated eraser 104 may or may not be similar to the cross-sectional shape of the lead pencil body 102. In one embodiment, the elongated eraser 104 is a circular cylinder (FIG. 4B) while the lead pencil body 102 is a hexagonal cylinder (FIG. 3A).

Figures 5A, 5B, 5C, 5D:
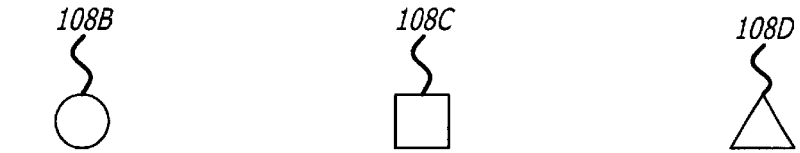
FIGS. 5A–5D are exemplary cross sectional views of a ferrule or eraser holder.

Referring now to FIGS. 5A–5D, exemplary cross-sectional shapes of the ferrule 108 are illustrated. In FIG. 5A, the ferrule 108A is a hollow hexagonal cylinder having a hexagonal cross-section. In FIG. 5B, the ferrule 108B is a hollow circular cylinder having a circular cross-section. In FIG. 5C, the ferrule 108C is a hollow square cylinder having a square cross-section. In FIG. 5D, the ferrule 108D is a hollow triangle cylinder having a triangular cross-section. In a preferred embodiment, the ferrule 108 is a hollow circular cylinder with a circular cross section. The inside diameter of the ferrule 108 may be similar or slightly larger than outside diameters of the elongated eraser 104 and the pencil body 102.

Figures 6A, 6B, 6C, 6D:
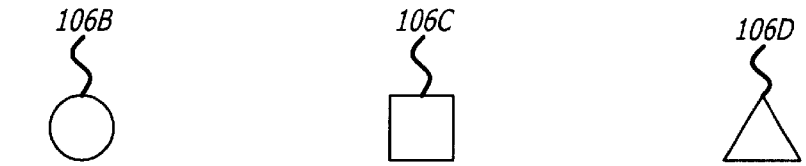
FIGS. 6A–6D are exemplary cross sectional views of an eraser sleeve.

Referring now to FIGS. 6A–6D, exemplary shapes of the eraser sleeve 106 are illustrated. In FIGS. 6A the eraser sleeve 106A is a hollow hexagonal cylinder having a hexagonal cross-section. In FIG. 6B, the eraser sleeve 106B is a hollow circular cylinder having a circular cross-section. In FIG. 6C, the eraser sleeve 106C is a hollow square cylinder having a square or rectangular cross-section. In FIG. 6D, the eraser sleeve 106D is a hollow triangular cylinder having a triangular cross-section. In a preferred embodiment, the eraser sleeve 106 is a hollow circular cylinder with a circular cross section. At one point, the inside diameter of the eraser sleeve 106 is slightly larger than outside diameters of the elongated eraser 104 and the pencil body 102. At another point, the eraser sleeve 106 has a tab or thread forming an inner diameter which is dimensioned to engage the outside diameter of the ferrule 108.

Referring now to FIG. 7, a writing instrument 100' is illustrated. The writing instrument 100' show some use and wear from that of the new writing instrument 100. Additionally, the writing instrument 100' has been sharpened so that pencil marks can be made by the lead center 300'. The writing instrument 100' includes the lead pencil body 102', the elongated eraser 104', the eraser sleeve 106, and the ferrule 108. The lead pencil body 102' has a shorter length than $L_p$ which is designated $L_p$ '. The elongated eraser 104' has a shorter length than as $L_e$ which is designated as $L_e$'. The lead pencil body 102' has a sharpened end 700 which, in a preferred embodiment, is conically shaped. The sharpened end 700 includes a sharpened lead center 300' having a tip or point 702. The tip or point 702 of the lead pencil body 102' is used to write onto an object, page, or paper. Having an elongated eraser 104', the wear of the eraser more closely matches the usage of the lead pencil body 102' in the writing instrument.

A number of embodiments of the ferrule 108 may be used to couple the pencil body 102 and the elongated eraser 104 together. However in order for the eraser sleeve 106 to selectively expose and protect the elongated eraser 104, the outer surface of the ferrule 108 and the inner surface of the eraser sleeve 106 include elements that allow gradual exposure of the eraser.

In one embodiment of the ferrule 108, concentric rings or slots are used to allow the eraser to be exposed in steps. In another embodiment of the ferrule 108, a screw thread is used to allow the sleeve to be rotated and gradually expose the eraser 104 in a continuous manner.

Referring now to FIGS. 8A–8B, magnified views of an embodiment of a ferrule 108A are illustrated. In FIG. 8A, a side view illustration, the ferrule 108A includes concentric slots or locking rings 802 and shoulders 804 in its outer surface. The steps in the concentric slots or locking rings 802 in the outer surface of the ferrule 108A, allow a stepped exposure of the elongated eraser 104 by the eraser sleeve 106. In FIG. 8B, a cut away illustration, the ferrule 108A includes a hollow cylindrical opening 806 to form the eraser socket 218 and the pencil socket 220.

Figure 9B:
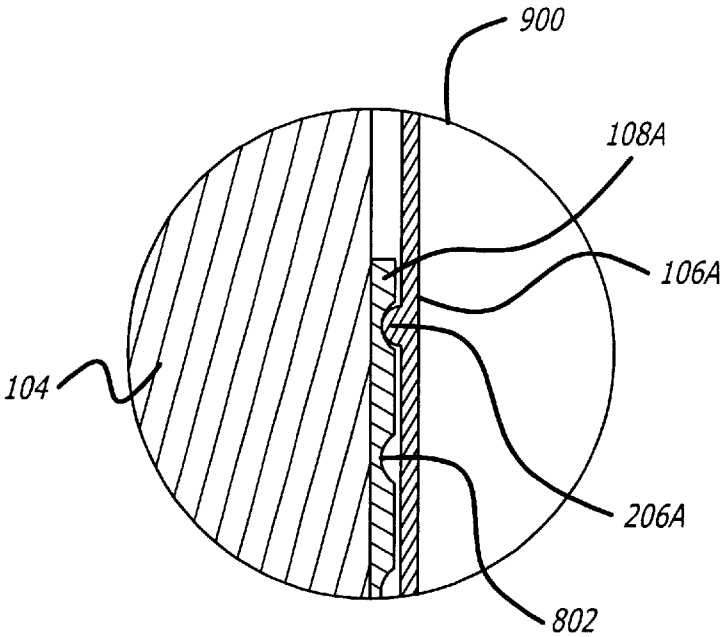
FIGS. 9A–9B are magnified views of an embodiment of the writing instrument incorporating the embodiment of the ferrule or eraser holder of FIGS. 8A–8B.
Figure 9A:
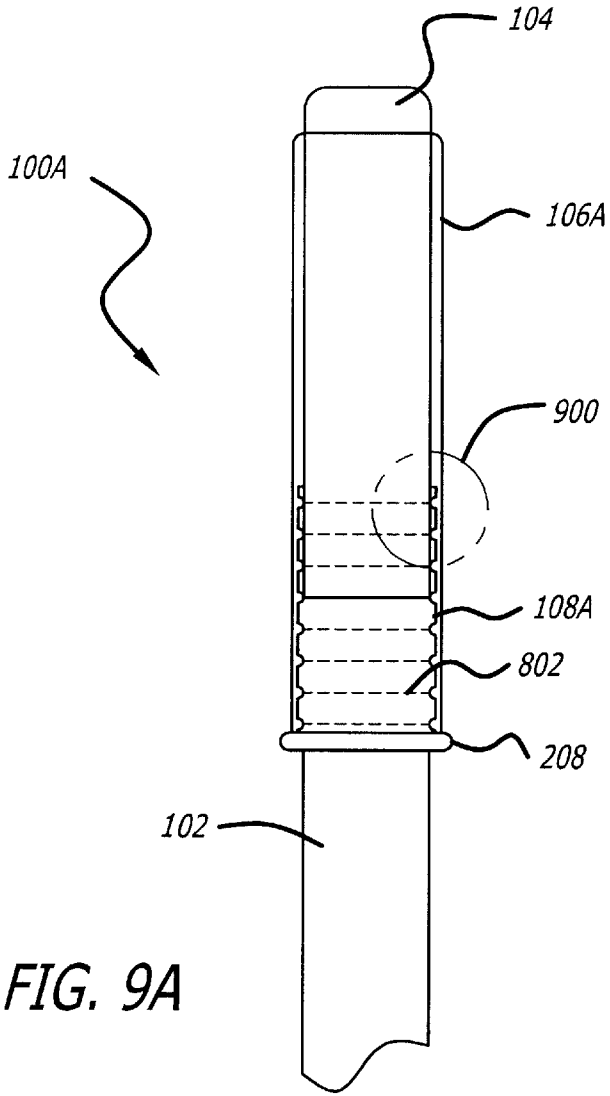

Referring now to FIGS. 9A–9B, magnified views of a writing instrument 100A are illustrated. The writing instrument or pencil 100A includes the embodiment of the ferrule 108A and eraser sleeve 106A as well as the lead pencil body 102 and the elongated eraser 104. In FIG. 9A, a cut away view, the eraser sleeve 106A engages the concentric slots or locking rings 802 in the ferrule 108A. The slots 802 may be annular slots around the ferrule or they may be individual slots in one or more faces of the ferrule to couple to one or more tabs of the eraser sleeve. A user slides the eraser sleeve from slot to slot in the ferrule to expose or cover the eraser 104 in a sequence of steps. In FIG. 9B, a cross-sectional view of area 900 of the writing instrument 10A, it is better shown how the tab 206A of the eraser sleeve 106A engages the concentric slot 802 of the ferrule 108A. The tab 206A may be an annular tab around the inside surface of the hollow circular cylinder of an eraser sleeve 106A or it may be one or more tabs in one or more respective sides of the inner surface of the eraser sleeve 106A.

Referring now to FIGS. 10A–10B, magnified views of an embodiment of the ferrule 108B are illustrated. In FIG. 10A, a side view illustration, the ferrule 108B includes a recess screw thread (i.e., a female thread) 1002 having screw shoulders 1004 in an outer surface. The female thread 1002 threadenly engages a portion of a male thread on the inner surface of the eraser sleeve 106. In an alternate embodiment, the thread types are swapped such that the ferrule has a male thread in its outer surface and the eraser sleeve has a female thread in its inner surface. In either case, the male thread may be a partial thread or thread tabs to engage a female thread in an alternate embodiment. The threads in the inner surface of the eraser sleeve 106 and the outer surface of the ferrule 108, allow a gradual exposure of the elongated eraser 104 by the eraser sleeve 106. A user rotates the eraser sleeve 106 to run it up and down the thread of the ferrule 108 to gradually cover or expose the elongated eraser 104. In FIG. 10B, a cut away view, the ferrule 108B includes a hollow cylindrical opening 1006 to form the eraser socket 218 and the pencil socket 220.

Figure 11B:
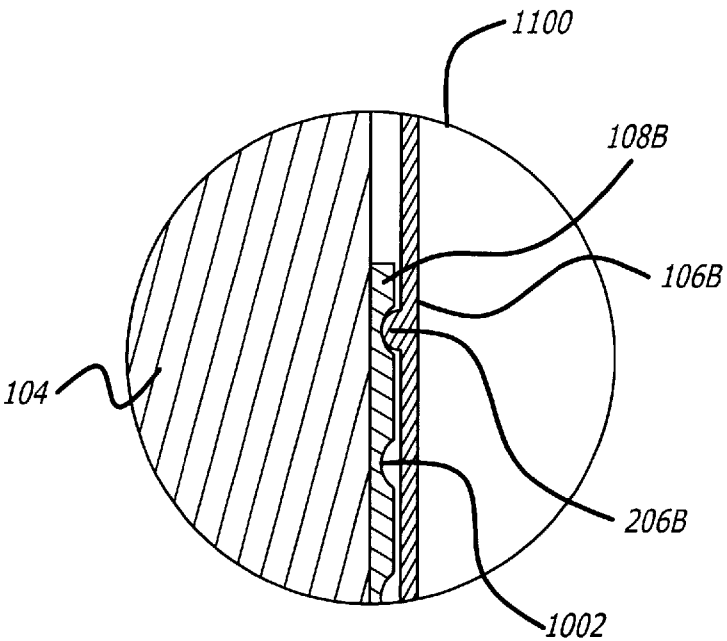
FIGS. 11A–11B are magnified views of an embodiment of the writing instrument incorporating the embodiment of the ferrule or eraser holder of FIGS. 10A–10B.
Figure 11A:
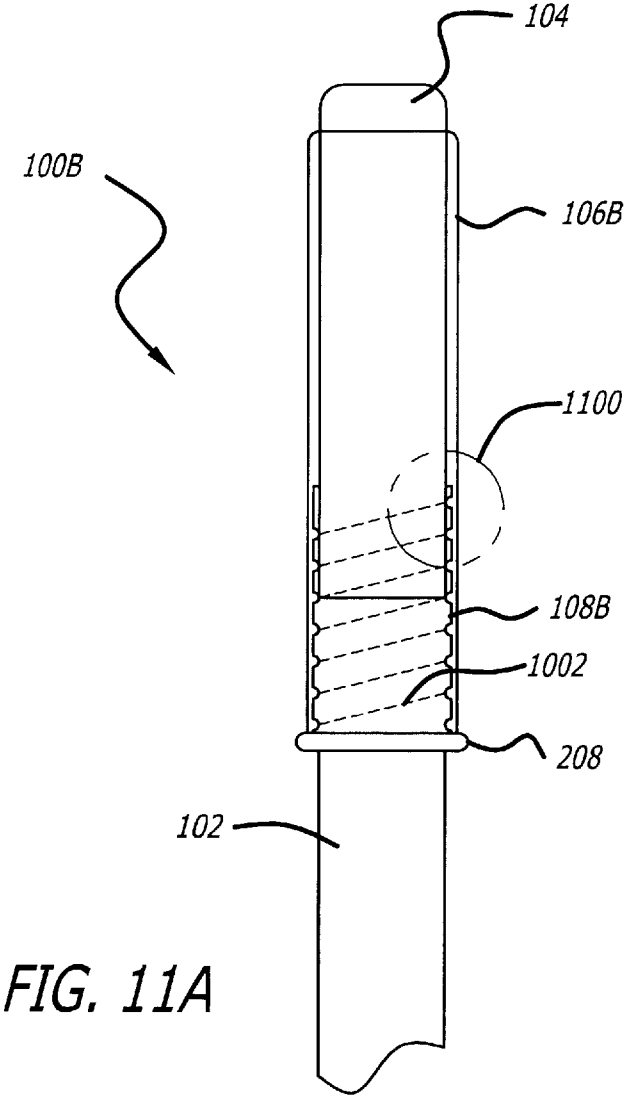

Referring now to FIGS. 11A–11B, magnified views of a writing instrument 100B are illustrated. The writing instrument or pencil 100B includes the embodiment of the ferrule 108B and eraser sleeve 106B as well as the lead pencil body 102 and the elongated eraser 104. In FIG. 11A, a cut away view, the eraser sleeve 106B engages the thread 1002 in the ferrule 108B. In FIG. 11B, a cross-sectional view of area 1100 of the writing instrument 100B, it is better shown how the thread 206B of the eraser sleeve 106B engages the thread 1002 of the ferrule 108B. The thread 206B may be a thread around the inside surface of the hollow circular cylinder of an eraser sleeve 106B or it may be one or more angulated tabs in one or more respective sides of the inner surface of the eraser sleeve 106B that can engage the thread 1002 of the ferrule 108B.

Figure 12A:
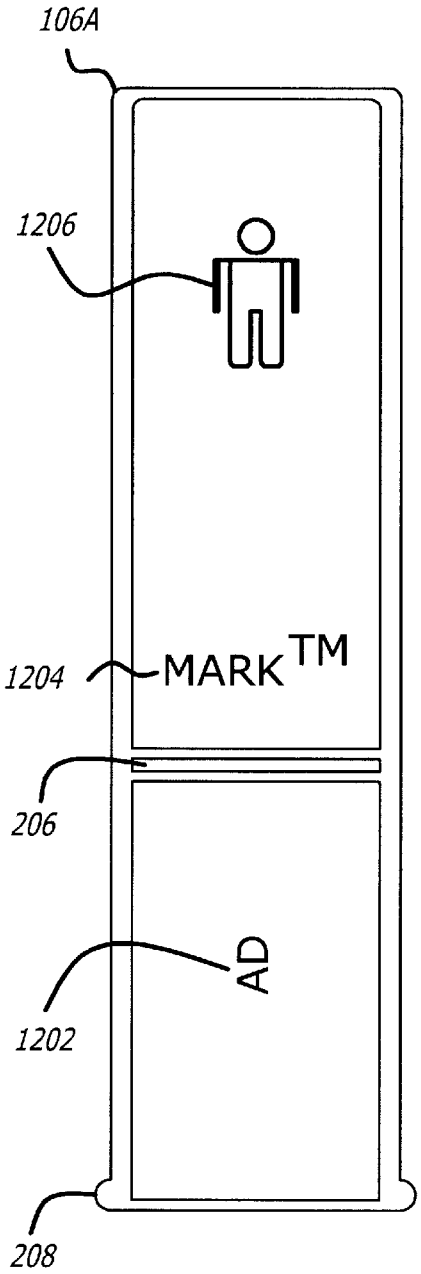
FIGS. 12A–12B are magnified views of alternate embodiments of the eraser sleeve.
Figure 12B:
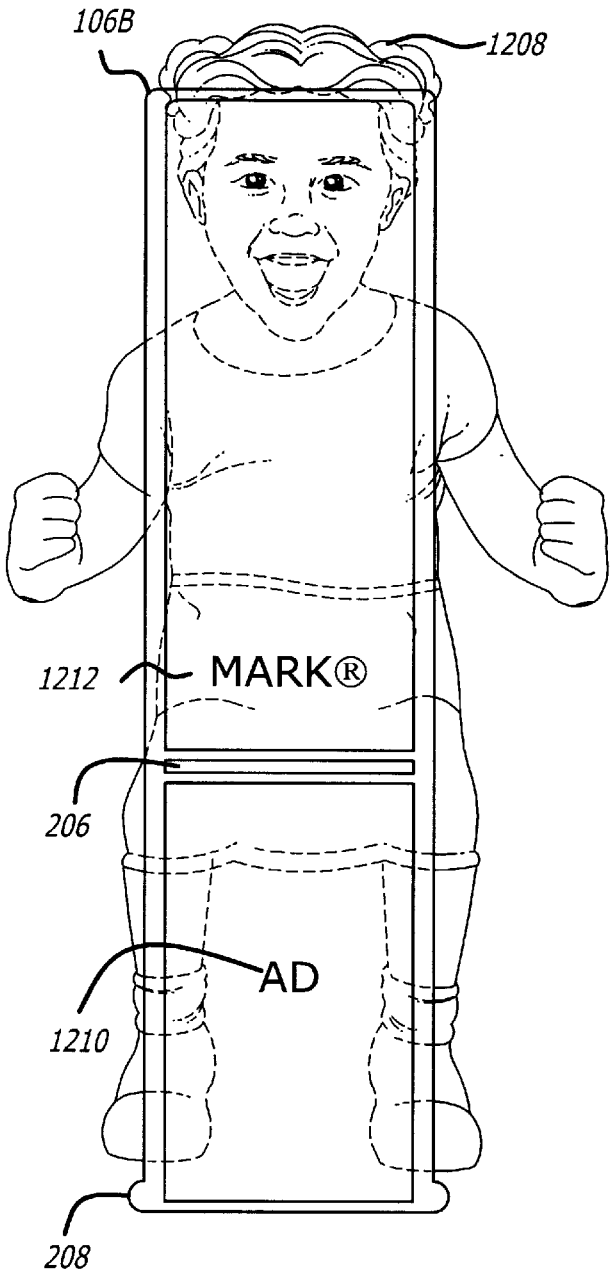

Referring now to FIGS. 12A–12B, magnified side views of the eraser sleeve 106 are illustrated. In FIG. 12A, the outer surface of the eraser sleeve 106A may include advertising 1202, a trademark 1204, or other printed letters, designs, or characters 1206. The advertising 1202, a trademark 1204, or other printed letters, designs, or characters 1206 may be stamped, printed or painted onto the sleeve or otherwise be integrated with the outer surface of the sleeve. In FIG. 12B, the eraser sleeve 106B has an outside shape of a character 1208. The eraser sleeve 106B may also include advertising 1210, a trademark 1212, or other printed letters or designs. The advertising 1210, trademark 1212, and other printed letters or designs may be stamped, printed or painted onto the sleeve or otherwise integrated with the outer surface thereof. Otherwise, the eraser sleeves 106A and 106B are similar to the embodiment previously described including the tab or thread 206 and may include the flange 208.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A writing instrument comprising:

a lead pencil having a first end and a second end;

a ferrule coupled to the second end of the lead pencil, the ferrule having one or more slots in an outer surface;

an elongated fixed eraser having a first end coupled to the ferrule and a second end free to erase pencil marks;

and an eraser sleeve moveably coupled to the one or more slots of the ferrule, the eraser sleeve covering an unused portion of the elongated fixed eraser and exposing an erasing portion of the elongated fixed eraser.

2. The writing instrument of claim 1, wherein the lead pencil is a wooden lead pencil.

3. The writing instrument of claim 1, wherein the lead pencil is a plastic lead pencil.

4. The writing instrument of claim 1, wherein the lead pencil is a non-mechanical lead pencil having a fixed lead center.

5. The writing instrument of claim 1, wherein the lead pencil requires sharpening to reveal additional graphite lead.

6. The writing instrument of claim 1, wherein the one or more slots in the outer surface of the ferrule are one or more concentric annular slots.

7. The writing instrument of claim 1, wherein the ratio of the usable length of the pencil to the usable length of the elongated fixed eraser is less than or equal to eight and one-third to one (8.33:1).

8. The writing instrument of claim 1, wherein the ratio of the usable length of the pencil to the usable length of the elongated fixed eraser is substantially equal.

9. The writing instrument of claim 1, wherein the elongated fixed eraser is non-replaceable.

10. The writing instrument of claim 1, wherein the sleeve has an advertising banner on an outside surface.

11. The writing instrument of claim 1, wherein the sleeve has an ornamental design on an outside surface.

12. The writing instrument of claim 1, wherein the sleeve has a character on an outside surface.

13. The writing instrument of claim 1, wherein the one or more slots are concentric circles around the ferrule.

14. The writing instrument of claim 13, wherein the eraser sleeve is slideably coupled to the one or more slots of the ferrule to slide over the ferrule to expose and cover the elongated fixed eraser in steps.

15. The writing instrument of claim 1, wherein the one or more slots tabs are formed from a thread around the ferrule.

16. The writing instrument of claim 15, wherein the eraser sleeve is rotatably coupled to the thread of the ferrule to turn around the ferrule to gradually expose and cover the elongated fixed eraser.

17. The writing instrument of claim 16, wherein the eraser sleeve includes a thread to threadingly couple to the thread around the ferrule.

18. A pencil comprising:

a lead pencil body having a sharpening end, a first butt end, and a lead center;

a hollow cylindrical ferrule having a first end and a second end, the first end of the hollow cylindrical ferrule being coupled onto the first butt end of the pencil body, the hollow cylindrical ferrule having one or more slots in an outer surface;

an elongated non-replaceable eraser having a second butt end coupled into the second end of the hollow cylindrical ferrule, the elongated non-replaceable eraser having an eraser end to erase pencil marks;

and a hollow cylindrical sleeve slideably coupled to the one or more slots in the outer surface of the hollow cylindrical ferrule, the hollow cylindrical sleeve covering and supporting an unused portion of the elongated non-replaceable eraser and exposing and supporting an erasing portion of the elongated non-replaceable eraser including the eraser end.

19. The pencil of claim 18, wherein the lead center is a color lead and the pencil is a color pencil.

20. The pencil of claim 18, wherein the lead center is a graphite lead and the pencil is a black pencil.

21. The pencil of claim 18, wherein the elongated non-replaceable eraser is a rubber eraser.

22. The pencil of claim 18, wherein the elongated non-replaceable eraser is a gum eraser.

23. The pencil of claim 18, wherein the hollow cylindrical sleeve includes a flange at a second end to engage the first end of the hollow cylindrical ferrule to keep it from sliding off over the elongated non-replaceable eraser.

24. The pencil of claim 18, wherein the one or more slots are one or more circular slots, and the hollow cylindrical sleeve includes a locking ring on an inner surface to engage the one or more circular slots in the outer surface of the hollow cylindrical ferrule to maintain a position of the hollow cylindrical sleeve over the elongated non-replaceable eraser.

25. The pencil of claim 18, wherein the one or more slots are one or more circular slots, and the hollow cylindrical sleeve includes at least one tab on an inner surface to engage the one or more circular slots in the outer surface of the hollow cylindrical ferrule to maintain a position of the hollow cylindrical sleeve over the elongated non-replaceable eraser.

26. A pencil comprising:

a lead pencil body having a sharpening end, a first butt end, and a lead center;

a hollow cylindrical ferrule having a first end and a second end, the first end of the hollow cylindrical ferrule being coupled onto the first butt end of the pencil body, the hollow cylindrical ferrule having a first thread in an outer surface;

an elongated non-replaceable eraser having a second butt end coupled into the second end of the hollow cylindrical ferrule, the elongated non-replaceable eraser having an eraser end to erase pencil marks;

and a hollow cylindrical sleeve having a second thread threadingly coupled to the first thread in the outer surface of the hollow cylindrical ferrule, the hollow cylindrical sleeve covering an unused portion of the elongated non-replaceable eraser.

27. The pencil of claim 26, wherein the hollow cylindrical sleeve further being able to expose and support an erasing portion of the elongated non-replaceable eraser including the eraser end.

28. The pencil of claim 26, wherein the lead center is a color lead and the pencil is a color pencil.

29. The pencil of claim 26, wherein the lead center is a graphite lead and the pencil is a black pencil.

30. The pencil of claim 26, wherein the elongated non-replaceable eraser is a rubber eraser.

31. The pencil of claim 26, wherein the elongated non-replaceable eraser is a gum eraser.

32. The pencil of claim 26, wherein the hollow cylindrical sleeve includes a flange at a second end to engage the first end of the hollow cylindrical ferrule to keep it from rotating off over the elongated non-replaceable eraser.

33. The pencil of claim 26, wherein the first thread is a female thread and the second thread is a male thread.

34. The pencil of claim 26, wherein the first thread is a male thread and the second thread is a female thread.

35. A method of forming a pencil comprising:

providing a cylindrical lead pencil body having a first end, a second end, and a lead center;

providing an elongated cylindrical eraser having a first end and a second end;

inserting the first end of the cylindrical lead pencil body into a first end of a hollow cylindrical ferrule;

inserting the first end of the elongated cylindrical eraser into a second end of the hollow cylindrical ferrule;

crimping the first end of the hollow cylindrical ferrule into the cylindrical lead pencil body;

crimping the second end of the hollow cylindrical ferrule into the elongated cylindrical eraser;

sliding a hollow cylindrical sleeve over the second end of the cylindrical lead pencil body;

and engaging an inner surface of the hollow cylindrical sleeve with an outer surface of the hollow cylindrical ferrule including screwing a screw tab in the hollow cylindrical sleeve onto a female thread in the outer surface of the hollow cylindrical ferrule.

36. The method of 35, wherein the hollow cylindrical sleeve to selectively expose and support an erasing portion of the elongated cylindrical eraser.

37. The method of 35, wherein the hollow cylindrical sleeve to selectively protect an unused portion of the elongated cylindrical eraser.

38. A method of forming a pencil comprising:

providing a cylindrical lead pencil body having a first end, a second end, and lead center;

providing an elongated cylindrical eraser having a first end and a second end;

inserting the first end of the cylindrical lead pencil body into a first end of a hollow cylindrical ferrule;

inserting the first end of the elongated cylindrical eraser into a second end of the hollow cylindrical ferrule;

crimping the first end of the hollow cylindrical ferrule into the cylindrical lead pencil body;

crimping the second end of the hollow cylindrical ferrule into the elongated cylindrical eraser;

sliding a hollow cylindrical sleeve over the second end of the cylindrical lead pencil body;

and;

engaging an inner surface of the hollow cylindrical sleeve with an outer surface of the hollow cylindrical ferrule including;

snapping a lock tab in the inner surface of the hollow cylindrical sleeve into a slot in the outer surface of the hollow cylindrical ferrule.

39. A method for assembling an eraser comprising:

providing a pencil with a ferrule to couple the pencil and the eraser together, the ferrule has a plurality of concentric slots in an outer surface; providing an eraser sleeve covering the eraser, the eraser sleeve has a tab to engage one of the plurality of slots; and to expose a portion of the eraser, the moving of the eraser sleeve is performed by moving the eraser sleeve sliding the tab of the eraser sleeve from one concentric slot in the ferrule to another to expose a portion of the eraser.

40. A method for assembling an eraser comprising:

providing a pencil with a ferrule to couple the pencil and the eraser together, the ferrule has a thread slot in an outer surface; providing an eraser sleeve covering the eraser, the eraser sleeve has a thread tab to engage the thread slot; and moving the eraser sleeve to expose a portion of the eraser, the moving of the eraser sleeve is performed by screwing the thread tab of the eraser sleeve down and around the thread slot to expose a portion of the eraser.

41. A pencil comprising:

a lead pencil having a sharpening end, a butt end, and a writing core;

an elongated eraser having a butt end and an eraser end;

an eraser holder having a pencil socket to receive the butt end of the pencil and an eraser socket to receive the butt end of the elongated eraser, the eraser holder being coupled to the lead pencil and the elongated eraser, the eraser holder further having an outer surface with a thread, and an eraser sleeve to cover, expose, and support the elongated eraser, the eraser sleeve having an inner surface with a thread to engage the thread of the eraser holder to control the exposure of the elongated eraser.

42. A pencil comprising:

a lead pencil having a sharpening end, a butt end, and a writing core; an elongated eraser having a butt end and an eraser end;

an eraser holder having a pencil socket to receive the butt end of the pencil and an eraser socket to receive the butt end of the elongated eraser, the eraser holder being coupled to the lead pencil and the elongated eraser, the eraser holder further having an outer surface with one or more concentric slots, and an eraser sleeve to cover, expose, and support the elongated eraser, the eraser sleeve having an inner surface with at least one tab to engage one of the one or more concentric slots of the eraser holder to control the exposure of the elongated eraser.

43. The pencil of claim 42, wherein the at least one tab is an annular tab to engage one of the one or more concentric slots of the eraser holder.

* * * * *